US006225917B1

(12) United States Patent
Berger

(10) Patent No.: US 6,225,917 B1
(45) Date of Patent: May 1, 2001

(54) ELECTROMAGNETIC FIELD PROBE HAVING A NON-ELECTRICAL TRANSMISSION MODALITY

(75) Inventor: H. Stephen Berger, Georgetown, TX (US)

(73) Assignee: Siemens Information and Communication Networks, Inc., Boca Raton, FL (US)

( * ) Notice: Subject to any disclaimer, the term of this patent is extended or adjusted under 35 U.S.C. 154(b) by 0 days.

(21) Appl. No.: 09/041,237

(22) Filed: Mar. 11, 1998

(51) Int. Cl.[7] ..... G08B 21/00

(52) U.S. Cl. ..... 340/870.16; 340/545.3; 340/870.18; 324/260

(58) Field of Search ..... 340/853.1, 853.5, 340/853.7, 854.6, 853.3, 854.7, 854.9, 855.6, 870.16, 855.5, 855.7, 545.3, 870.18; 367/81, 83; 324/244.1, 260

(56) References Cited

U.S. PATENT DOCUMENTS 4,788,545 * 11/1988 Farque ..... 340/854.9
4,891,641 * 1/1990 Gard et al. ..... 340/854.9
5,363,095 * 11/1994 Normann et al. ..... 340/854.7
5,675,674 * 10/1997 Weis ..... 385/12

OTHER PUBLICATIONS

Safety Considerations for Human Exposure to EMF's from Mobile Telecommunication Equipment (MTE) in the Frequency Range 30 MHz—6 GHz; Apr. 30, 1996; European Committee for Electrotechnical Standardization, SECRETARIAT SC 211/B, WGMTE96/4; pp. 39–44.

* cited by examiner

*Primary Examiner*—Michael Horabik
*Assistant Examiner*—Timothy Edwards, Jr.

(57) ABSTRACT

A probe for measuring an electromagnetic field is described. A sensing element senses the electromagnetic field and generates a sensing signal indicative thereof. The sensing signal is characterized by a first modality. First conversion circuitry coupled to the sensing element converts the sensing signal to a second modality. A transmission medium coupled to the first conversion circuitry transmits the sensing signal in the second modality. Measurement circuitry coupled to the transmission medium receives the sensing signal in the second modality and generates measurement data corresponding to the electromagnetic field.

27 Claims, 6 Drawing Sheets

ELECTROMAGNETIC FIELD PROBE HAVING A NON-ELECTRICAL TRANSMISSION MODALITY

BACKGROUND OF THE INVENTION

The present invention relates to the problem of accurately measuring electromagnetic fields. More specifically, the present invention provides an electromagnetic field probe which accurately measures electromagnetic fields while reducing the interaction of the probe with the field.

Currently, the most commonly used types of electromagnetic field probes interact with the field they are attempting to measure to an undesirable degree. This is largely due to the fact that electrically conductive lines are employed to transmit the detected signal from the probe to the instrumentation. It is well known that such electrically conductive lines generate their own electromagnetic fields and also interact with and alter the field being measured, thereby adversely affecting the accuracy of the measurement.

In addition, currently available probes lack sophistication in that they are only able to measure the amplitude of the field. The frequency content of the field, an obviously important field parameter, is not measured.

Both of these problems have been addressed to some degree by recent, experimental, optically-based technology. Unfortunately, other limitations continue to make commercial viability for such technology problematic. Not only do optically-based probes tend to be very expensive initially, they are also mechanically fragile resulting in a high cost for maintenance and repair.

It is therefore desirable to provide an electromagnetic field probe which reduces the effects on the field to be measured by the probe itself and its cables. It is also desirable for such a probe to provide information about a measured field beyond its amplitude.

SUMMARY OF THE INVENTION

According to the present invention, an electromagnetic probe is provided which avoids the use of electrically conductive transmission lines to transmit information about a measured field from the probe to its accompanying instrumentation. The probe of the present invention includes conversion circuitry for converting the signal received from the probe's sensing element(s) from an electrical modality to, for example, an acoustic or optical modality. The converted signal is then transmitted via the appropriate medium to the measurement instrumentation where it is converted back to an electrical modality and analyzed for information regarding the measured field. The effect on the measured field of the transmission of the converted signal to the instrumentation is negligible because the frequency content of the converted signal and any fields generated by the transmission are significantly different from unconverted sensing signal.

According to various embodiments, the quality and fidelity of the transmitted converted signal may be enhanced according to any of a variety of analog and digital signal processing techniques. For example, a wide variety of encoding schemes may be employed with the present invention to encode the converted signal. Alternatively, a wide variety of modulation schemes may be employed to enhance the fidelity of the transmitted signal. For example, the converted signal may be used to modulate a carrier.

According to other embodiments of the invention, manipulation of the sensor output using various techniques facilitates reliable and accurate determination of field parameters. According to one specific embodiment in which the field of interest has a modulation in the audio frequency band, the sensor output is rectified resulting in a signal in the audio frequency band. The rectified signal is transmitted to a transceiver which converts the electrical signal to an acoustic signal for transmission to the probe's instrumentation. According to more specific embodiments, the rectified sensor output may be amplified, encoded, or used to modulate a carrier before being converted and transmitted as an acoustic signal.

According to another specific embodiment, an RF field of known frequency and amplitude is added to the field of interest. The probe's sensor generates a mixed signal representative of the combined fields. This heterodyning produces several field components including a difference component which corresponds to the difference between the frequencies of the two fields. Using the known frequency of the second field, the frequency of the field being measured may be derived.

According to yet another embodiment, a second transceiver receives the converted signal and converts it back to its first modality for use in generating a reference signal for the purpose of calibrating the loss in the transmission medium. The signal is then reconverted to the second modality for transmission to the instrumentation via the transmission medium.

Thus, the present invention provides a probe for measuring an electromagnetic field. A sensing element senses the electromagnetic field and generates a sensing signal indicative thereof. The sensing signal is characterized by a first modality. First conversion circuitry coupled to the sensing element converts the sensing signal to a second modality. A transmission medium coupled to the first conversion circuitry transmits the sensing signal in the second modality. Measurement circuitry coupled to the transmission medium receives the sensing signal in the second modality and generates measurement data corresponding to the electromagnetic field.

A further understanding of the nature and advantages of the present invention may be realized by reference to the remaining portions of the specification and the drawings.

DESCRIPTION OF SPECIFIC EMBODIMENTS

Figure 1:
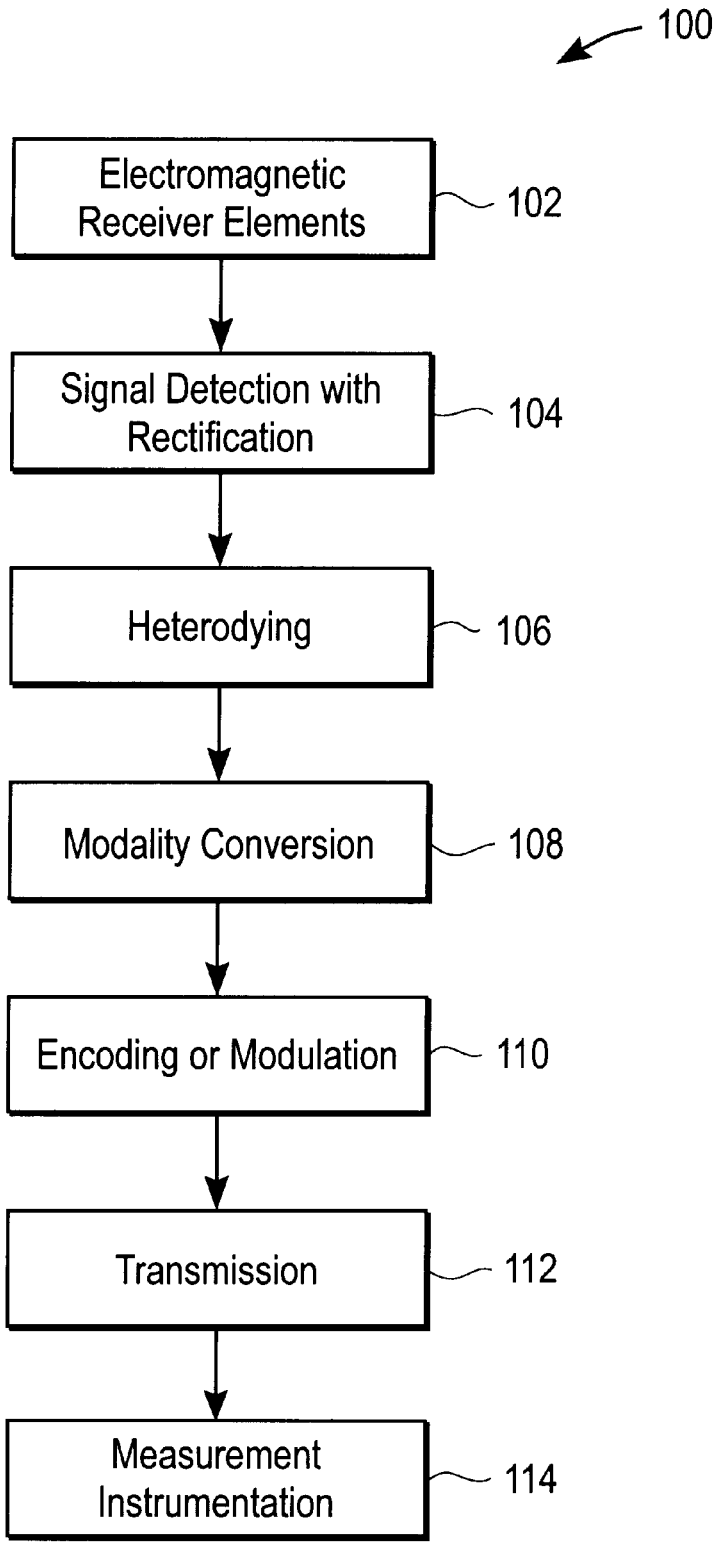
FIG. 1 is a flow diagram illustrating the measurement of a field of interest according to a specific embodiment of the invention.

FIG. 1 is a flow diagram 100 illustrating the measurement of a field of interest according to a specific embodiment of the invention. Initially, the field is sensed using receiver elements which are appropriate to the nature of the field and for the field environment (102). For example, an electrical field may be sensed using dipole elements. Alternatively, a magnetic field may be sensed in one or more dimensions using the appropriate number of orthogonal loops. It will be understood that depending upon the type of field to be measured, any of a wide variety of sensor technologies and configurations may be employed without departing from the scope of the invention.

The sensed signal is then detected, i.e., converted into an electrical signal (104). In specific embodiments, detection may include rectification of the signal. According to one such embodiment, a field probe is provided which is optimized for measuring an electromagnetic field having a modulation in the audio frequency band. The rectified signal is thus in the audio frequency band. For many commonly used detectors, the rectified audio frequency signal is proportional to the square of the voltage across the detector's junction. Thus, the rectified signal has a known and fixed relationship to field strength and may be used to accurately determine field amplitude. Such a probe is useful, for example, in measuring fields associated with digital PCS transmission devices.

According to specific embodiments, during or after detection, the signal may be combined, or heterodyned, with a second field of known frequency and amplitude (106). The mixed signal includes a difference component from which the frequency of the field of interest may be determined. The second field may be, for example, an RF field or an acoustic field.

The modality of the acquired and processed signal is then converted to a second modality (108) before being transmitted to the measurement instrumentation associated with the probe. If, for example, the signal is an electrical signal it may be converted to an acoustic signal. Alternatively, the electrical signal may be converted to an optical, e.g., infrared, signal. This modality conversion allows information regarding the measured field to be transmitted outside the probe while having only negligible interaction with the measured field. This is due in part to the fact that the information is transmitted via an electrically nonconductive medium. Thus, for example, an acoustic signal may be transmitted via air or an electrically nonconductive acoustic transmission line. Similarly, an optical signal may be transmitted via an electrically nonconductive optical transmission line.

According to some embodiments, before the converted signal is transmitted to the instrumentation it may be further processed to ensure transmission fidelity (110). For example, depending upon the modality to which the signal has been converted it may be encoded using any of a variety of analog or digital encoding techniques. Alternatively, the converted signal may be used to modulate a carrier wave which is then transmitted to the instrumentation.

The signal is then transmitted to the measurement instrumentation (112). As mentioned above, interference with the field of interest is avoided because the content of the transmitted information is such that its interaction with the field of interest is negligible. The measurement instrumentation receives the signal transmitted from the probe and determines the desired information regarding the field, e.g., field amplitude and frequency (114).

Figure 2:
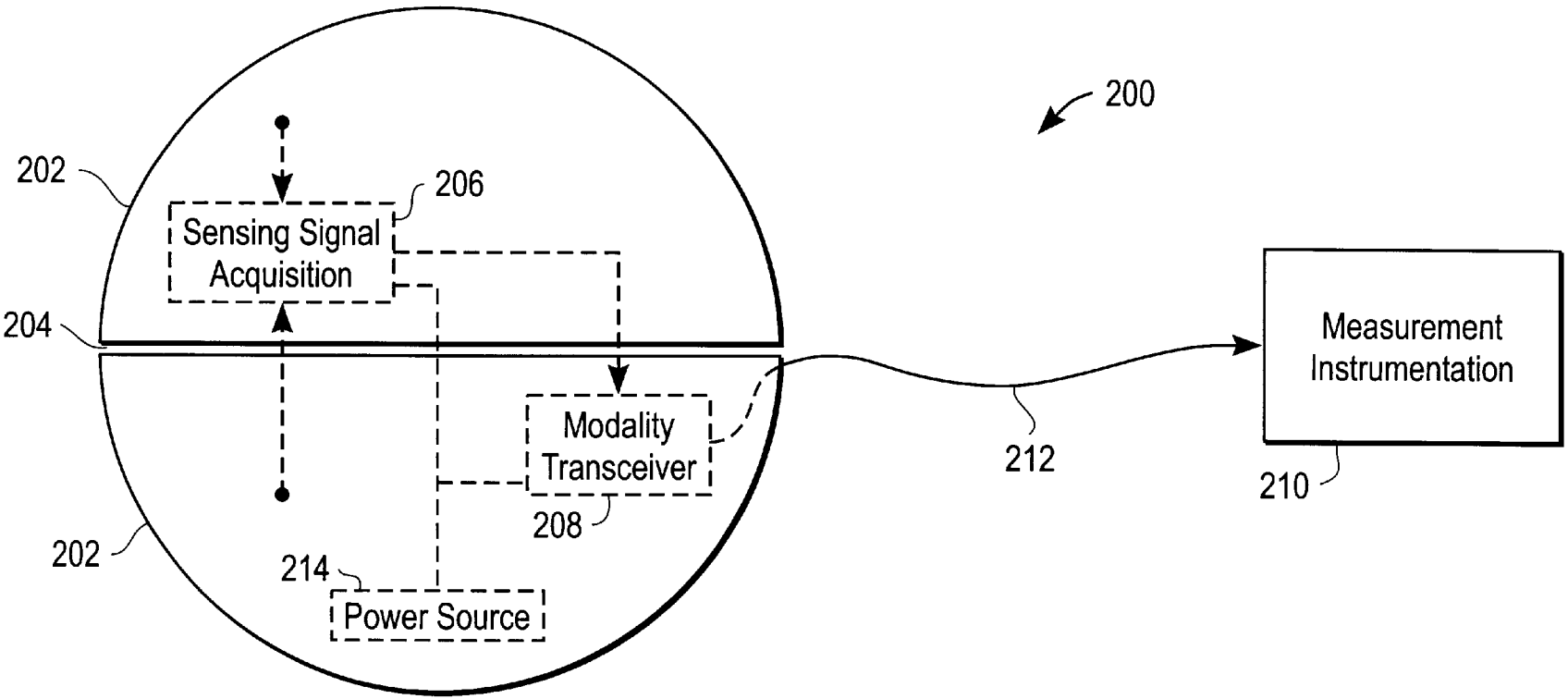
FIG. 2 is a simplified diagram of an electromagnetic field probe designed according to a specific embodiment of the invention.

FIG. 2 is a simplified diagram of an electromagnetic field probe 200 designed according to a specific embodiment of the invention. Two hemispherical field sensing elements 202 form a hollow sphere with a gap 204 between the elements 202. The electronics are provided within the sphere. In another specific embodiment, the electronics are provided in a hollow sensing elements which is a hollow tube formed into a circle. Such a configuration is appropriate for sensing magnetic fields.

Sensing signal acquisition circuitry 206 is coupled to each of the hemispherical elements 202 and comprises one or more detectors which detect and rectify the signal received from sensing elements 202. Dipole elements may be used for the measurement of electric fields while loops or shielded loops may be used for the measurement of magnetic fields. When isotropic response is desired the elements may be designed to have negligible directionality. Where the measured field has modulation content in the audio frequency band, rectification of the sensed signal produces an audio frequency signal which, for most common detectors (e.g., silicon nonlinear junctions) will be proportional to the square of the voltage across the junction. This fixed relationship to the field strength may be used for determining the strength of the field of interest.

The rectified electrical signal is delivered to a modality transceiver 208 which converts it to another modality. According to one embodiment, transceiver 208 converts the signal to an acoustic signal which is then transmitted outside of the sphere to measurement instrumentation 210 via an acoustic transmission line 212. In a specific embodiment line 212 is a 2 mm acoustic transmission line. According to various embodiments, before the rectified signal is transmitted to transceiver 208, it may be amplified, encoded, or used to modulate a carrier signal. A power source 214 provides power to the sensing circuitry. Power source 214 may be, for example, a battery. Alternatively, power source 214 may be an optical transceiver which receives power optically transmitted to the probe from outside of the hemispheres and distributes the power to the internal circuitry.

The result of the modality change effected by modality transceiver 208 is that the only conductive objects near the field of interest are within the hemispherical probe elements. There is virtually no effect on the field of interest from the transmission of information from the probe head to the instrumentation.

Figure 3:
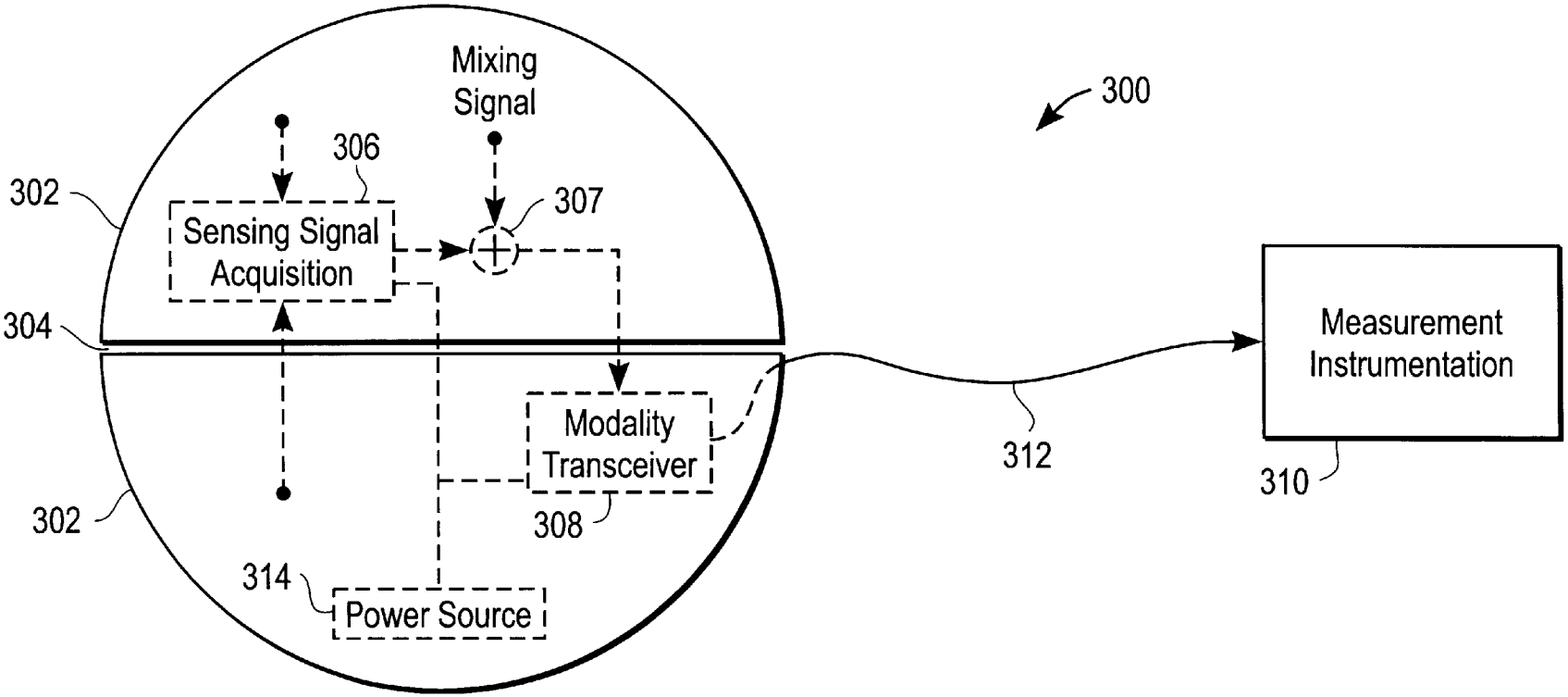
FIG. 3 is a simplified diagram of an electromagnetic field probe designed according to another specific embodiment of the invention.

FIG. 3 is a simplified diagram of an electromagnetic field probe 300 designed according to another specific embodiment of the invention. Hollow hemispherical sensing elements 302 form a hollow sphere with a gap 304. Sensing signal acquisition circuitry 306 detects and, according to some embodiments, also rectifies the signal received from sensing elements 302. As with probe 200, dipole elements may be used for the measurement of electric fields while loops or shielded loops may be used for the measurement of magnetic fields. When isotropic response is desired the elements may be designed to have negligible directionality.

An additional RF field of known frequency and amplitude (i.e., the mixing signal) may be introduced and combined, or heterodyned, with the field of interest. This is represented by summing junction 307. The sensing signal then becomes a mixed signal, the difference component of which may be employed to determine the frequency content of the field of interest.

The rectified and/or heterodyned electrical signal is delivered to a modality transceiver 308 which converts it to another modality. According to one embodiment, transceiver 308 converts the signal to an acoustic signal which is then transmitted outside of the sphere to measurement instrumentation 310 via acoustic transmission line 312. In a specific embodiment line 312 is a 2 mm acoustic transmission line. According to various embodiments, before the rectified signal is transmitted to transceiver 308, it may be amplified, encoded, or used to modulate a carrier signal. A power source 314 provides power to the sensing circuitry. Power source 314 may be, for example, a battery. Alternatively, power source 314 may be an optical transceiver which receives power optically transmitted to the probe from outside of the hemispheres and distributes the power to the internal circuitry.

Figure 4:
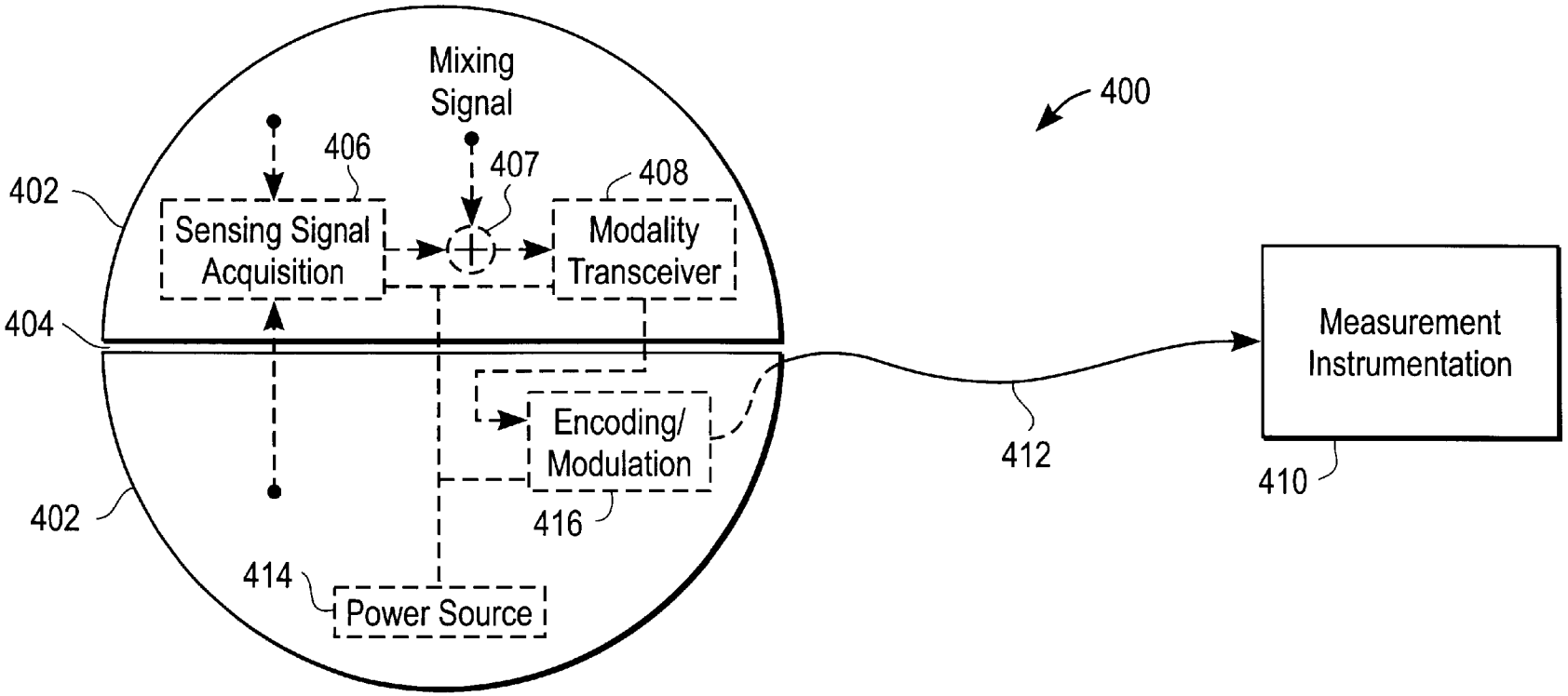
FIG. 4 is a simplified diagram of an electromagnetic field probe designed according to yet another specific embodiment of the invention.

FIG. 4 is a simplified diagram of an electromagnetic field probe 400 designed according to yet another specific embodiment of the invention. Probe 400 operates similarly to probe 300 with similarly number elements performing substantially the same functions as described above with reference to FIG. 3. However, in this embodiment, the converted signal is further processed by encoding/modulation circuitry 416 before transmission to instrumentation 410. That is, the converted signal may be encoded using any of a variety of well known analog and digital encoding techniques to ensure the fidelity of the signal received by the instrumentation. Alternatively, signal fidelity may be enhanced by using the converted sensing signal to modulate an appropriate carrier signal.

Figure 5:
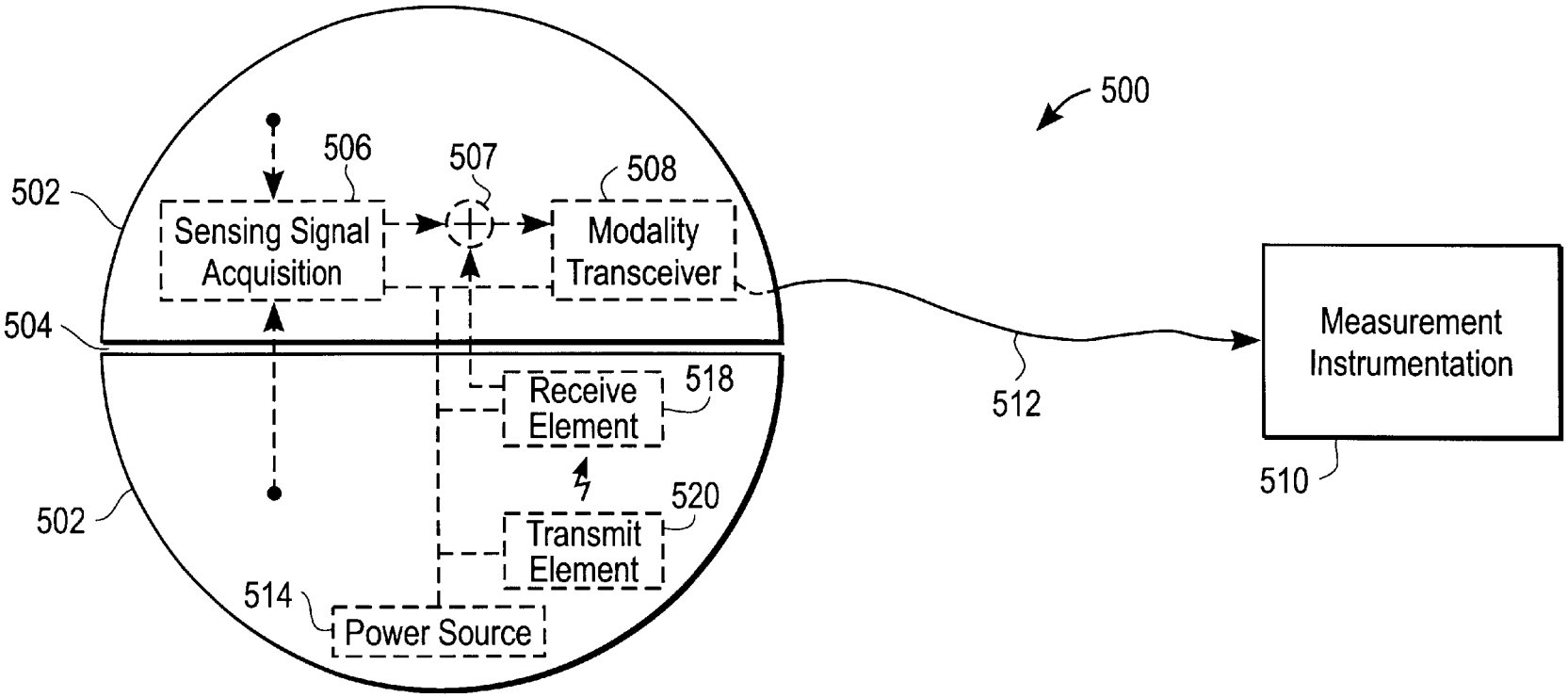
FIG. 5 is a simplified diagram of an electromagnetic field probe which illustrates an implementation variation which may be incorporated into any of the embodiments described herein.

FIG. 5 is a simplified diagram of an electromagnetic field probe 500 which illustrates an implementation variation which may be incorporated into any of the above-described embodiments. Elements numbered similarly to elements in previously described embodiments operate substantially the same. This embodiment of the invention allows accurate calibration of the transmission loss of the transmission line between the probe head and the instrumentation, i.e., line 512. A receive element 518 is provided in the sphere of the probe which may be, for example, a microphone where probe 500 is an acoustic output probe. Alternatively, receive element 518 may be an optical receiver where probe 500 has an optical output.

A transmit element 520 transmits a reference signal the content of which is appropriate to be detected by receive element 518, e.g., an acoustic or optical signal. In this embodiment, transmit element 520 is shown inside hemispherical elements 502. However, it will be understood that transmit element may be entirely outside of probe 500. Receive element converts the transmitted reference signal to an electrical signal which is combined with the sensing signal at summing junction 507 before being converted to the appropriate modality by modality transceiver 508 for transmission to instrumentation 510. According to various embodiments, the combination of signals at summing junction 507 comprises a modulation of the reference signal by the sensing signal. The modulation may be of amplitude, frequency, phase, or any of a variety of modulation techniques. The probe is calibrated for a relationship between field strength and deviation of the reference signal. The strength of the field of interest may thus be determined based on this relationship.

Figure 6:
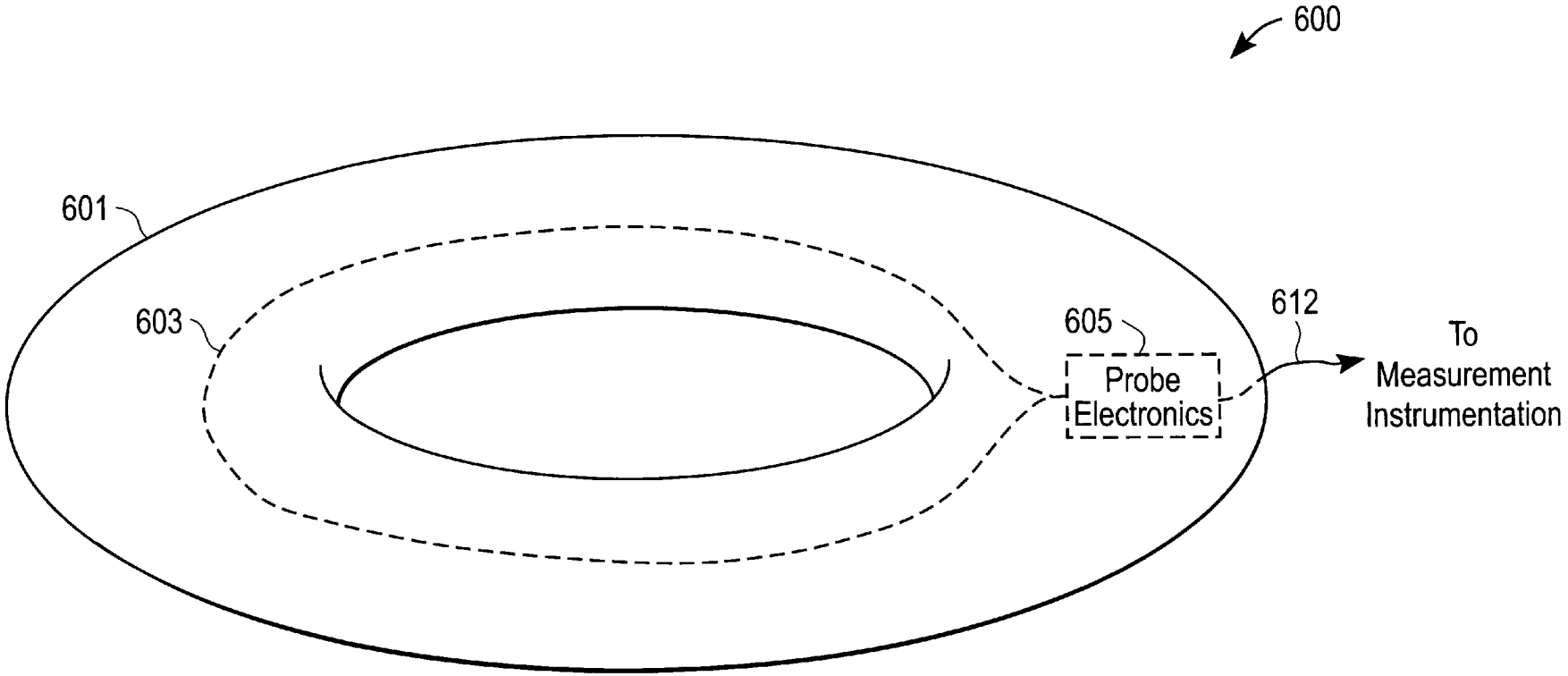
FIG. 6 is a simplified diagram of an electromagnetic field probe in a toroidal housing.

FIG. 6 is a simplified diagram of an magnetic field probe 600 in a toroidal housing 601. Sensing element 603 comprises a loop which is coupled to probe electronics 605 which may be configured as described above with reference to FIGS. 2–5 and includes a modality transceiver (not shown) for converting the electrical signal generated by probe electronics 605 to a mode, e.g., acoustic or optical, which is then transmitted via an appropriate medium 612 to the associated measurement instrumentation (not shown). Probe 600 may have any or all of the features discussed above with regard to different embodiments and is included herein as an example of one of the many possible alternative configurations which may be employed with the present invention.

While the invention has been particularly shown and described with reference to specific embodiments thereof, it will be understood by those skilled in the art that changes in the form and details of the disclosed embodiments may be made without departing from the spirit or scope of the invention. For example, specific embodiments of the invention have been described having spherical or toroidal probe heads. However, a variety of sensor types and probe head configurations may be employed and remain within the scope of the invention. For example, as discussed above, dipole elements may be used in a variety of configurations to sense electric fields. Alternatively, a variety of loop configurations may be used to sense magnetic fields. Therefore, the scope of the invention should be determined with reference to the appended claims.

What is claimed is:

1. A probe for measuring an electromagnetic field, comprising:

a sensing element for sensing the electromagnetic field and generating a sensing signal indicative thereof, the sensing signal being characterized by a first modality;

a rectifier coupled to the sensing element for rectifying the sensing signal;

first conversion circuitry coupled to the sensing element for converting the sensing signal to a second modality;

a transmission medium coupled to the first conversion circuitry for transmitting the sensing signal in the second modality; and measurement circuitry coupled to the transmission medium for receiving the sensing signal in the second modality and generating measurement data corresponding to the electromagnetic field.

2. The probe of claim 1 further comprising:

mixing circuitry coupled to the sensing element combining the sensing signal with a heterodyning signal while the sensing signal is characterized by the first modality.

3. A probe for measuring an electromagnetic field, comprising:

a sensing element for sensing the electromagnetic field and generating a sensing signal indicative thereof, the sensing signal being characterized by a first modality, mixing circuitry coupled to the sensing element combining the sensing signal with a heterodyning signal while the sensing signal is characterized by the first modality:

first conversion circuitry coupled to the sensing element for converting the sensing signal to a second modality; and a transmission medium coupled to the first conversion circuitry for transmitting the sensing signal in the second modality;

measurement circuitry coupled to the transmission medium for receiving the sensing signal in the second modality and generating measurement data corresponding to the electromagnetic field.

4. A probe for measuring an electromagnetic field, comprising:

a sensing element for sensing the electromagnetic field and generating a sensing signal indicative thereof, the sensing signal being characterized by a first modality;

first conversion circuitry coupled to the sensing element for converting the sensing signal to a second modality;

a transmission medium coupled to the first conversion circuitry for transmitting the sensing signal in the second modality;

mixing circuitry for combining the reference signal with the sensing signal before the sensing signal is converted to the second modality; and measurement circuitry coupled to the transmission medium for receiving the combined sensing and reference signal in the second modality and generating measurement data corresponding to the electromagnetic field.

5. The probe of claim 4 wherein the reference signal is employed for calibration of loss in the transmission medium.

6. The probe of claim 1, 3, or 4 further comprising a battery for providing power to the probe.

7. The probe of claim 1, 3, or 4 further comprising optical transmission lines for providing power to the probe.

8. The probe of claim 1, 3, or 4 further comprising electrically conductive transmission lines for providing power to the probe.

9. The probe of claim 1, 3, or 4 further comprising encoding circuitry coupled to the first conversion circuitry for encoding the sensing signal before transmission to the measurement circuitry.

10. The probe of claim 1, 3, or 4 further comprising a modulator coupled to the first conversion circuitry for modulating a carrier signal with the sensing signal before transmission to the measurement circuitry.

11. The probe of claim 1, 3, or 4 wherein the transmission medium comprises air.

12. The probe of claim 1, 3, or 4 wherein the transmission line comprises an acoustic transmission line.

13. The probe of claim 1, 3, or 4 wherein the sensing element is isotropic.

14. The probe of claim 1, 3, or 4 wherein the sensing element is directional.

15. The probe of claim 1, 3, or 4 wherein the sensing element is electrical.

16. The probe of claim 1, 3, or 4 wherein the sensing element is magnetic.

17. The probe of claim 1, 3, or 4 wherein the sensing element is responsive to field power.

18. The probe of claim 1, 3, or 4 wherein the transmission medium comprises an optical transmission line.

19. The probe of claim 18 wherein the optical transmission line is operable to transmit infrared energy.

20. A method for measuring an electromagnetic field, comprising:

sensing the electromagnetic field with a sensing element thereby generating a sensing signal, the sensing signal being characterized by a first modality;

converting the sensing signal to a second modality;

rectifying the sensing signal while the sensing signal is characterized by the first modality;

transmitting the sensing signal in the second modality to measurement circuitry; and measuring the electromagnetic field with the measurement circuitry.

21. The method of claim 20 further comprising heterodyning the sensing signal with a heterodyning signal while the sensing signal is characterized by the first modality.

22. A method for measuring an electromagnetic field, comprising:

sensing the electromagnetic field with a sensing element thereby generating a sensing signal, the sensing signal being characterized by a first modality;

converting the sensing signal to a second modality;

heterodyning the sensing signal with a heterodyning signal while the sensing signal is characterized by the first modality;

transmitting the sensing signal in the second modality to measurement circuitry; and measuring the electromagnetic field with the measurement circuitry.

23. The method of claim 20 or 22 further comprising encoding the sensing signal before transmission to the measurement circuitry.

24. A method for measuring an electromagnetic field, comprising:

sensing the electromagnetic field with a sensing element thereby generating a sensing signal the sensing signal being characterized by a first modality;

heterodyning the sensing signal with a heterodyning signal while the sensing signal is characterized by the first modality;

combining the reference signal with the sensing signal before the sensing signal is converted to the second modality;

converting the sensing signal to a second modality;

transmitting the sensing signal in the second modality to measurement circuitry; and generating measurement data corresponding to the electromagnetic field with the measurement circuitry.

25. The method of claim 20, 22, or 24 further comprising modulating a carrier signal with the sensing signal before transmission to the measurement circuitry.

26. The method of claim 20, 22, or 24 wherein the second modality comprises an acoustic modality and transmitting the sensing signal is achieved via an acoustic medium.

27. The method of claim 20, 22, or 24 wherein the second modality comprises an optical modality and transmitting the sensing signal is achieved via an optical medium.

* * * * *